United States Patent [19]

Tsutaki

[11] 4,378,512

[45] Mar. 29, 1983

[54] HELIX TYPE TRAVELING WAVE TUBE

[75] Inventor: Kunio Tsutaki, Tokyo, Japan

[73] Assignee: Nippon Electric Co., Ltd., Tokyo, Japan

[21] Appl. No.: 176,681

[22] Filed: Aug. 8, 1980

[30] Foreign Application Priority Data

Aug. 8, 1979 [JP] Japan ..... 54-101450
Dec. 24, 1979 [JP] Japan ..... 54-167840

[51] Int. Cl.[3] ..... H01J 25/34
[52] U.S. Cl. ..... 315/3.6; 315/39.3
[58] Field of Search ..... 315/3.5, 3.6, 39.3; 333/34

[56] References Cited

U.S. PATENT DOCUMENTS

| | | | |
|---|---|---|---|
| 3,433,992 | 3/1969 | Tancredi et al. | 315/3.6 |
| 3,614,517 | 10/1971 | Dionne | 315/3.6 |
| 3,678,326 | 7/1972 | Heynisch | 315/3.6 |
| 3,758,811 | 9/1973 | Wong | 315/3.6 |
| 3,761,760 | 9/1973 | Harper et al. | 315/3.6 |
| 4,107,572 | 8/1978 | Yuasa et al. | 315/3.6 |

*Primary Examiner*—Saxfield Chatmon, Jr.
*Attorney, Agent, or Firm*—Laff, Whitesel, Conte & Saret

[57] ABSTRACT

A helix-type traveling wave tube delay line extends from an input side to an output side. An electron gun adjacent the input side of the helix means transmits an electronic beam to a collector adjacent the output side. An attenuator divides the helix at a location between the input side and the output side. Between the attenuator and input, the helix has a pitch ($P_0$). Between the attenuator and the output, the pitch ($P_1$) of the helix is greater than the pitch ($P_0$) to form a fast velocity circuit. The pitch ($P_2$) of a second part of the helix between the attenuator and output is less than the pitch ($P_0$) to form a slow velocity circuit. A third part of the helix is interposed between the first and second parts to form a velocity taper section having a helical pitch which varies from the larger pitch ($P_1$) to the smaller pitch ($P_2$). One fairly central position in the third part of the helix has an average pitch of $(P_1+P_2)/2$. A first length ($L_1$) of the helix includes all of the first part and continues to the position of average pitch. A second length ($L_2$) of the helix includes all of the second part and continues to the position of average pitch. The ratio $L_1/L_2$ ranges from 0.6 to 2, and the ratio $(2(P_1-P_2)/(P_1+P_2))$ of the difference between pitches $P_1$ and $P_2$ to the average pitch ranges from 0.04 to 0.14.

7 Claims, 6 Drawing Figures

HELIX TYPE TRAVELING WAVE TUBE

BACKGROUND OF THE INVENTION

The present invention relates to a traveling wave tube which includes a helix type delay line circuit having a velocity taper for suppression of the backward traveling wave oscillation.

As is well known in the art, a traveling wave tube is constructed with an electron gun section for emitting an electron beam. A delay line section causes interactions between the electron beam and electromagnetic waves. A collector section collects the electrons which have finished their interactions with the electromagnetic waves. An electromagnetic wave output section guides the electromagnetic waves into the delay line circuit section. Among sections, the delay line section reduces the phase velocity of the electromagnetic waves, coming from an electromagnetic input section, to a low level which is substantially the same as the velocity of the electron beam, while maintaining the synchronous relationship between the electron beam and the electromagnetic wave. There is an amplifying action. Delay line circuits are constructionally classified into several types including a helix type delay line circuit and a coupled cavity type delay line circuit. The present invention is directed to helix type delay line circuits.

Because of constructional simplicity in comparison with the coupled cavity or other delay line circuits, the helix type delay line circuit has conventionally been used widely as the delay line circuit of a high frequency amplifying tube, for relatively low or intermediate power. However, the helix type delay line circuit is thermally weak because it is constructed so that a helix or a thin wire coil is supported by means of dielectric rods having a low thermal conductivity. The helix type delay line circuit produces a backward wave oscillation if it is operated in a high frequency and with a high power. Therefore, it has not been used as a high frequency and power amplifying tube. However, the thermal problems of the helix type traveling wave tube have recently been solved, with the progress of the manufacturing technique. At the same time, it becomes necessary to suppress the oscillations of the backward traveling waves.

According to an analysis of the electromagnetic field of a helix, it can propagate many space harmonics as well as the fundamental waves which have positive phase and group velocities. The fundamental waves, not harmonics, are practically used for amplification. The backward traveling oscillating waves constitute the problem in the helix type traveling wave tube, are caused by the interactions between the electron beam and the backward traveling component of the minus-1 space harmonic having a positive phase velocity and a negative group velocity. This minus-1 space harmonic component is increased with the increase in free space with the phase constant ka (where $Ka=\omega a/c$, wherein: $\omega$ stands for the angular frequency of the electromagnetic waves; c stands for the velocity of light; and a stands for the average radius of the helix). In the high frequency and power type of helix-type traveling wave tube, on the other hand, the phase constant is $\beta a$ (where $\beta a=\omega a/v_p$, wherein: $\omega$ stands for the angular frequency of the electromagnetic waves; $v_p$ stands for the phase velocity of the electromagnetic waves; and a stands for the average radius of the helix). The electromagnetic waves propagated on the helix have to be selected with a value within a preset range (1 to 2). Since the operating voltage has to be increased by the requirement for the output power and the beam focus, the value of the phase constant ka is also increased so that the backward traveling waves become liable to oscillate.

For suppressing the oscillations of the backward waves, two methods have conventionally been proposed. One is the method published in the International Electron Device Meeting (IEDM) in December, 1978 by the paper (pp526–529) which employs dielectric rods for supporting the helix, which is baked with an electromagnetic wave absorbing material having a meandering line shape to selectively attenuate a frequency which is around the frequency at which the backward traveling wave oscillation occurs. This attenuation suppresses the backward wave oscillations. This first method can produce a tube having a satisfactory operating characteristics. Not only the frequency of the backward wave oscillation but also all of the frequencies other than those in the used band of the fundamental waves can be considerably attenuated. However, the technique of baking the dielectric rods with the electromagnetic wave absorbing material having the meandering shape is so difficult that the first method impractical.

A second method is disclosed in U.S. Pat. No. 3,761,760 issued Sept. 25, 1973 to R. Harper et al, which provides an output-side delay line circuit with a special velocity taper. This second method is based on the concept that the energy of the electromagnetic waves is absorbed by the electron beam if there are interactions between the fast space charge waves of the electron beam and the electromagnetic waves. Therefore, the backward traveling wave oscillation can be suppressed if the oscillation frequency of the backward traveling waves and the fast space charge waves are coupled at an electromagnetic wave attenuator on the output-side of a delay line circuit.

According to this second method, however, it is necessary to provide a velocity taper at a rate as high as about 20% to the phase velocity. Therefore, it has the disadvantages that the matching characteristics deteriorate for the fundamental waves. An additional length of the tube is necessary for the suppression of the backward traveling wave oscillation, which increases the length of the tube. Another disadvantage of the second method is that the plasma frequency and the oscillation frequency cannot be determined on principle when the helix pitch has an effect upon the synchronism between the fast space charge waves and the backward traveling waves. A further disadvantage of the second method is that the synchronism between the fast space charge waves and the backward traveling waves is really difficult because of the production accuracy of the helix size causes an operational instability.

SUMMARY OF THE INVENTION

It is, therefore, an object of the present invention to provide a helix type traveling wave tube which can effectively suppress the backward traveling wave oscillation.

Another object of the present invention is to provide a helix type traveling wave tube which can suppress the backward traveling wave oscillation, which has a shorter tube length, and which is easily manufactured and handled, without any difficulty.

A further object of the present invention is to provide a helix type traveling wave tube which can operate stably.

The present invention employs a velocity taper in the output-side delay line circuit but, as in the aforementioned second method. However, the concept of suppressing the backward traveling wave oscillation differs from the prior art in that the present invention is based upon the fact that the backward traveling wave oscillation takes place as the result of the coupling between the backward traveling wave component of the minus-1 space harmonic and the electron beam. Thus, the frequency range for their interaction is remarkably narrow in comparison with the frequency range in which the fundamental waves and the electron beam interact with each other. The inventive method is practical because a velocity taper can be used that exerts little influence upon the operations of the fundamental waves.

According to the present invention, a helix type traveling wave tube comprises an electron gun, a collector, an electromagnetic wave input section, an electromagnetic wave output section, and a helix type delay line circuit. The helix is divided midway for high frequency by an electromagnetic wave attenuator. The delay line circuit between the electromagnetic wave attenuator and the electromagnetic wave output section is divided into three sections. A first section is a fast velocity circuit where the helix has a fixed pitch ($P_1$) which is longer than the pitch ($P_0$) of the helix of the delay line circuit that is between the electromagnetic wave input section and the electromagnetic wave attenuator. A second section is a slow velocity circuit where the helix has a fixed pitch ($P_2$) which is shorter than $P_0$. A third section is a velocity taper section where the helix pitch is different and varies from the longer pitch to the shorter pitch. The tube of the present invention is characterized in that it has a ratio ($L_1/L_2$) where the length ($L_1$) is the length of the delay line circuit between one end of the electromagnetic wave attenuator on the side of the collector and a position on the tube axis in the velocity taper section where the helix of the velocity taper section has an average pitch ($(P_1+P_2)/2$); and the length ($L_2$) of the delay line circuit between the position of the average pitch and where the electromagnetic wave output section ranges from 0.6 to 2. The ratio ($2(P_1-P_2)/(P_1+P_2)$) of the differences between the average pitch and the longer pitch and the shorter pitch ranges from 0.04 to 0.14.

According to the present invention, moreover, a helix type traveling wave tube has a ratio between the length ($L_3$) of the velocity taper section of the delay line circuit and the total length ($L_1+L_2$) of the output-side delay line circuit which satisfies the following inequality:

$$I_{col}/I_{sto} < 13.3 \times [L_3/(L_1+L_2)] + 6.7$$

where: $I_{sto}$ repesents a backward traveling wave oscillation starting current when the whole delay line circuit is constructed with the average pitch ($(P_1+P_2)/2$) and $I_{col}$ is an operation current of the tube.

DETAILED DESCRIPTION OF THE PREFERRED EMBODIMENTS

Figure 1:
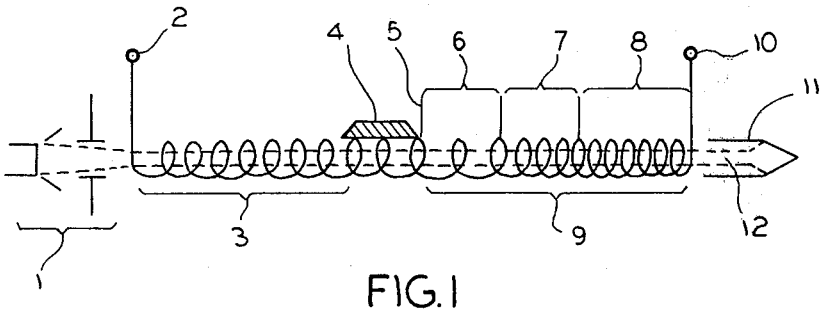
FIG. 1 is a diagrammatical view showing the construction of a helix type traveling wave tube according to the present invention.

FIG. 1 is a diagrammatical view showing the construction of the traveling wave tube according to the present invention. In FIG. 1: reference numeral 1 indicates an electron gun; 2 an electromagnetic wave input section; 3 an input side delay line circuit; 4 an electromagnetic wave attenuator; 5 one end of the electromagnetic wave attenuator on the side of the collector; 6 a high velocity circuit section of an output side delay line circuit; 7 a velocity taper section; 8 a low velocity circuit section of the output side delay line circuit; 9 the output-side delay line circuit; 10 an electromagnetic wave output section; 11 a collector; and 12 an electron beam.

In the case of fundamental waves, as shown, the electron gun 1 emits an electron beam 12, which interacts with the high frequency signal, fed through the electromagnetic wave input section 2. The electron beam 12 travels toward the collector 11, while being modulated by the amplified high frequency signal. In the course of traveling, the high frequency signal is almost attenuated by the electromagnetic wave attenuator 4.

Immediately after having passed through the electromagnetic wave attenuator 4, a high frequency signal is induced by the modulated electron beam at the high velocity circuit section 6 on the output-side delay line circuit 9. The induced signal interacts again with the electron beam 12, so that it is amplified and delivered to the external load from the electromagnetic wave output section 10. The pitch ($P_1$) in the helix of the high velocity circuit section 6 of the output-side delay line circuit 9 is larger than the pitch ($P_0$) of the helix of the input side delay line circuit 3 where the electromagnetic wave is made synchronous with the electron beam. The pitch ($P_2$) of the helix of the low velocity circuit section 8 in the output side delay line circuit 9 is smaller than the pitch ($P_0$) of the input side delay line circuit.

With these pitches, the nonlinear distorsion can be improved as compared to the distortion in a traveling wave tube, which is equipped with a delay line circuit having a constant helix pitch and no velocity taper. There is a deterioration of the electron beam efficiency for the fundamental waves. The conditions required for the respective pitches depend on both the low velocity circuit section 8 and the high velocity circuit section 6 of the output side delay line circuit 9. Both of these sections may contribute to the amplification of the fundamental waves because the synchronous range of the traveling wave tube is substantially in the order of a coupling parameter C. The ratio $2(P_1-P_2)/(P_1+P_2)$ of the difference between $P_1$ and $P_2$ to the average pitch $(P_1+P_2)/2$ at the velocity taper section 7 is lower than 0.14.

The backward traveling wave component of the minus-1 space harmonic has a frequency that is synchronous with the velocity of the electron beam 12. This component is generated by the thermal disturbances in the delay line circuit in the vicinity of the electromagnetic wave output section 10. The disturbance travels in a direction which is opposite to the direction of the electron beam 12, and interacts with and is amplified by the electron beam, until it is finally absorbed by the electromagnetic wave attenuator 4. At this time, the backward traveling wave might become infinite until it reaches the electromagnetic wave attenuator. If it does become infinite in the tube, the backward traveling wave goes into oscillation.

According to a detailed analysis by the inventor, the conditions required for the high velocity and low velocity circuit sections 6 and 8 of the output side delay line circuit to contribute to the amplification of the backward traveling waves is given when the ratio $2(P_1-P_2)/(P_1+P_2)$ is equal to lower than 0.04. Therefore, this ratio should be higher than 0.04.

Figure 2:
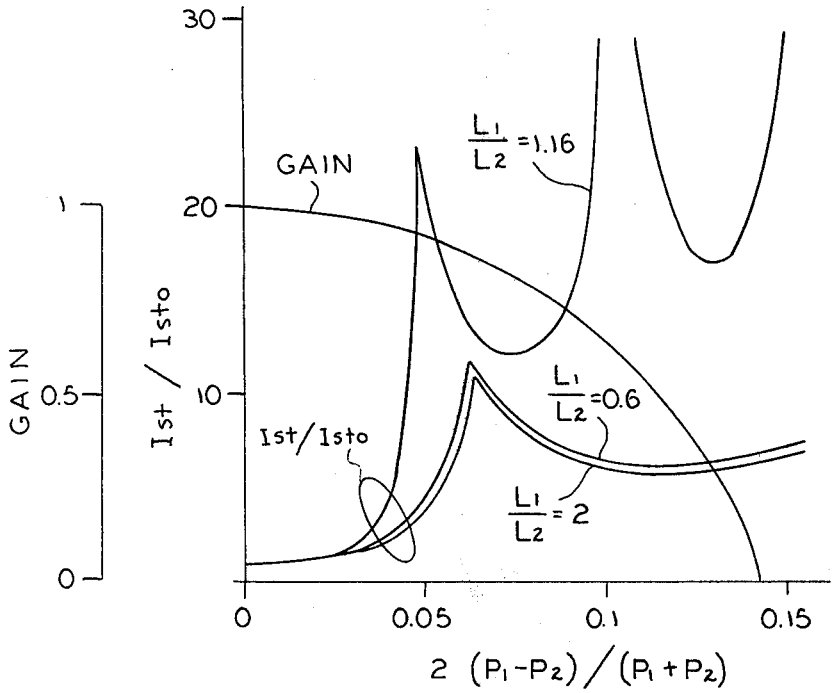
FIG. 2 is a graphical presentation illustrating the relationship between the ratio $I_{st}/I_{sto}$ and $2(P_1-P_2)/(P_1+P_2)$ as well as the relationship between the gain reduction of the fundamental waves at an attenuator side section and $2(P_1-P_2)/(P_1+P_2)$.

FIG. 2 illustrate the relationship between a current for starting the backward traveling wave oscillation and the ratio $2(P_1-P_2)/(P_1+P_2)$ which will be explained in detail below. In conclusion, the pitches $P_1$ and $P_2$ should meet the following condition, in order for the high and low velocity circuit sections 6 and 8 to amplify the fundamental waves and not to amplify the minus-1 space harmonic:

$$0.04<2.(P_1-P_2)/(P_1+P_2)<0.14$$

Figure 3:
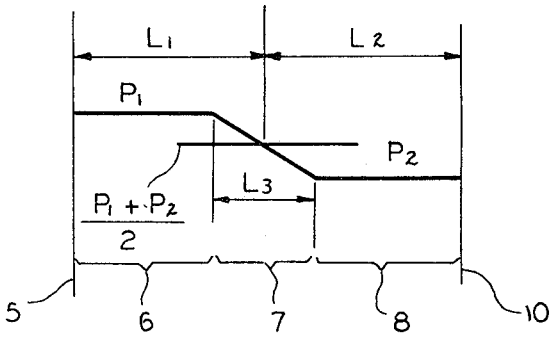
FIG. 3 illustrates $L_1$, $L_2$, $L_3$, $P_1$, and $P_2$ in the output side delay line circuit.

FIG. 2 illustrates the ratio $I_{st}/I_{sto}$ between the current ($I_{sto}$) for starting the backward traveling wave oscillation at the output side delay line circuit, where the helix of the delay line circuit of the tube has a constant pitch equal to the average pitch $((P_1+P_2)/2)$, and the current ($I_{st}$) for starting the backward traveling wave oscillation in the case of the present invention having the velocity taper, as a function of the ratio $2(P_1-P_2)/(P_1+P_2)$. The ratio $(L_1/L_2)$ is taken as a parameter, where: $L_1$ is the length of the delay line circuit between the collector side end 5 of the electromagnetic wave attenuator and the position on the tube axis in the velocity taper section 7 where the helix of the velocity taper section has the average pitch $(P_1+P_2)/2$; and $L_2$ is the length of the delay line circuit between the position of the average pitch and the electromagnetic wave output section 10, as shown in FIG. 3.

FIG. 2 further shows the reduction in the gain of the high velocity circuit section 6 of the output side delay line circuit, as a function of the ratio $2(P_1-P_2)/(P_1+P_2)$ of the fundamental waves. The gain is shown, as 1 for $P_1=P_2$. In the case where: $L_1/L_2=1.16$, (FIG. 2), the value of $1_{st}/I_{sto}$ is gradually increased while the value of $2(P_1-P_2)/(P_1+P_2)$ is low, but this valve abruptly rises when the value of $2(P_1-P_2)/(P_1+P_2)$ comes close to 0.04, until it reaches a value as high as 20 when the value of $2(P_1-P_2)/(P_1+P_2)$ comes close to 0.047. After that, the value of $I_{st}/I_{sto}$ decreases with the increase in the value of $2(P_1-P_2)/(P_1+P_2)$ until it reaches its minimum when the value of $2(P_1-P_2)/(P_1+P_2)$ comes close to 0.075. After the value of $2(P_1-P_2)/(P_1+P_2)$ became to 0.075, if it is further increased, the value of $1_{st}/I_{sto}$ reaches its peak higher than 30. With the value of $2(P_1-P_2)/(P_1+P_2)$ in the vicinity of 0.13, the value of $1_{st}/I_{sto}$ reaches a minimum as low as 17. On the other hand, even if the value of $L_1/L_2$ becomes higher or lower than 1.16, the value of $2(P_1-P_2)/(P_1+P_2)$, giving the peak and minimum values of $I_{st}/I_{sto}$, is increased, and the peak and minimum values are themselves decreased. For the ratio of $L_1/L_2$ at values of 0.6 and 2, more specifically, the ratio $I_{st}/I_{sto}$ assumes its peak of 12 when the ratio of $2(P_1-P_2)/(P_1+P_2)$ comes close to 0.062.

The minimum value of 6 is reached for the value of $2(P_1-P_2)/(P_1+P_2)$ in the vicinity of 0.12.

The aforementioned characteristics of the velocity taper, according to the present invention, can be explained in the following manner when consideration is taken of the backward traveling wave components at the output side delay line circuit 9, (i.e., the backward wave component which is synchronized at the high velocity section 6). The backward wave component is synchronized at the low velocity section 8. The backward wave component is synchronized at the average pitch of $((P_1+P_2)/2)$ and at the velocity taper section 7.

In the case where $L_1/L_2=1.16$, and with the value of $2(P_1-P_2)/(P_1+P_2)$ being 0.04 or less, the difference between the helix pitches of the high velocity section 6 and the low velocity section 8 of the output side delay line circuit is remarkably small. Both of those circuit sections contribute to the amplification of the backward traveling wave component which is synchronized at the average pitch $((P_1+P_2)/2)$. These backward traveling wave component becomes so dominant that the value of $I_{st}/I_{sto}$ is hardly increased for the value of $2(P_1-P_2)/(P_1+P_2)$.

When the value of $2(P_1-P_2)/(P_1+P_2)$ becomes higher than 0.04, the contributions of the high velocity and low velocity sections 6 and 8 of the output side delay line circuit to the backward traveling wave component are gradually decreased. These contributions are synchronized at the average pitch $((P_1+P_2)/2)$, but the backward traveling wave component of the respective circuit section is increased. As a result, the energy of the backward traveling wave is divided into three kinds of components, and the value of $I_{st}/I_{sto}$ becomes higher than 20 when the value of $2(P_1-P_2)/(P_1+P_2)$ becomes close to 0.047. If this value of $2(P_1-P_2)/(P_1+P_2)$ is further increased, the backward traveling wave component synchronized at the average pitch $((P_1+P_2)/2)$ is decreased. The two backward traveling wave components synchronized at the high and low velocity sections 6 and 8 of the output side delay line circuit become dominant so that the value of $I_{st}/I_{sto}$ is gradually decreased. At last, the backward traveling wave component synchronized at the average pitch $((P_1+P_2)/2)$ disappears when the value of $2(P_1-P_2)/(P_1+P_2)$ comes close to 0.12 so that the value of $I_{st}/I_{sto}$ assumes its minimum. After that, the value of $I_{st}/I_{sto}$ is again increased to repeat its peak and minimum values. However, these subsequent behaviors have no relationship within the scope of the claims of the present invention, and as such their explanations are omitted here.

In the cases of $L_1/L_2=0.6$ and 2, since one of the two backward traveling wave components synchronized at the high velocity section 6 and the low velocity section 8 of the output side delay line circuit becomes stronger than the other, the values of $2(P_1-P_2)/(P_1+P_2)$ giving the peak and minimum values of $I_{st}/I_{sto}$ are increased so that the peak and minimum values themselves are decreased. Therefore, the conditions required for the high velocity and low velocity sections 6 and 8 to contribute to the suppression of the backward travelling waves are either that the backward traveling wave components synchronized at the high velocity section 6, that synchronized at the low velocity section 8 and that synchronized at the average pitch $((P_1+P_2)/2)$ are coexisting or that the backward traveling wave component synchronized at the high velocity section 6 and that synchronized at the low velocity section 8 are coexisting. Then, the ratio of $2(P_1-P_2)/(P_1+P_2)$ should be higher than 0.04.

In FIG. 2, on the other hand, a gain may be taken for the fundamental waves at the low velocity section 8 of the output side delay line circuit. If so, gain at the high velocity section 6 is zero when the value of $2(P_1-P_2)/(P_1+P_2)$ is larger than 0.14. Therefore, if the upper limit of the value $2(P_1-P_2)/(P_1+P_2)$ is 0.14, the gain exists for the fundamental waves below that limit.

Accordingly, the conditions for suppressing the backward traveling wave oscillation and for obtaining a gain for the fundamental waves, at the attenuator side section 6 of the output side delay line circuit, are given by the following inequality:

$$0.04<2(P_1-P_2)/(P_1+P_2)<0.14 \quad (1)$$

It is favorable for the helix pitch Po of the input side delay line circuit 3 to be made equal to or near the average pitch $(P_1+P_2)/2$.

Here, the basic difference between the present invention and the disclosure of the aforementioned U.S. Pat. No. 3,761,760 is that, in the present invention, the low velocity section 8 and the high velocity section 6 of the output side delay line circuit are constructed to avoid oscillation of the backward traveling waves. In accordance with the disclosure of U.S. Pat. No. 3,761,760, the backward traveling waves oscillate at the low velocity section 8 but not at the high velocity section 6. According to the present invention, moreover, a gain can be made for the fundamental waves at the high velocity section 6 and the low velocity section 8 of the output side delay line circuit, by setting the value of $2(P_1-P_2)/(P_1+P_2)$ within a range from 0.04 to 0.14. The disclosure of U.S. Pat. No. 3,761,760 is different in that the value of $2(P_1-P_2)/(P_1+P_2)=0.16$ is selected, for example, so that there is no gain at the high velocity section 6. Therefore, the present invention is advantageous over U.S. Pat. No. 3,761,760 since the output side delay line circuit 9 can be shortened.

Figure 4:
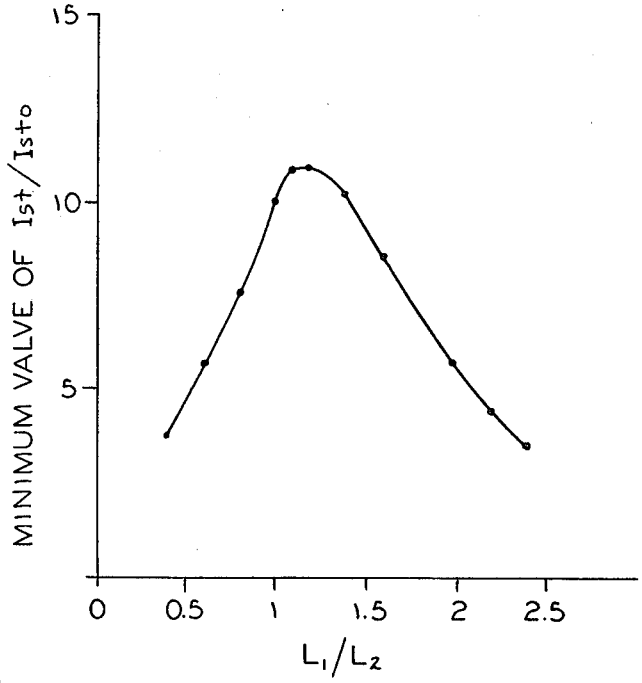
FIG. 4 is a graphical presentation illustrating the variation of the minimum value of the ratio $I_{st}/I_{sto}$ of FIG. 2 to the ratio $L_1/L_2$ after the ratio $I_{st}/I_{sto}$ rises.

FIG. 4 illustrates the variation of the first minimum value of $I_{st}/I_{sto}$ in FIG. 2, for the value $L_1/L_2$. As has been described hereinbefore, the minimum value of $I_{st}/I_{sto}$ assumes its maximum for the value $L_1/L_2-1.16$ so that it becomes smaller regardless whether the value $L_1/L_2$ is increased or decreased from 1.16. For the value $L_1/L_2=0.6$ or 2, the value $I_{st}/I_{sto}$ is reduced to become as small as 6. In the case of the usual traveling wave tube, the conditions for suppressing the backward traveling wave oscillation are dependent upon the operating current, but the minimum value of $I_{st}/I_{sto}$ has to be larger than 6. Therefore, the position for the velocity taper, to become effective for the suppression of the backward traveling wave oscillation, may be selected to fall below the range which is given by the following inequality:

$$0.6<L_1/L_2<2 \quad (2)$$

As understood from the foregoing description, the pitches of the attenuator side section 6 and the collector side section 8 of the output side delay line circuit 9 are within the range defined by the inequality (1). The position of the velocity taper section 7 is located within the range which is defined by the inequality (2). Then, it is possible to provide a helix type traveling wave tube which can generate high frequency outputs, while suppressing the backward traveling wave oscillation, without either deterioration of the electron beam efficiency or an appreciable elongation of the tube.

Next to be described is the relationship between the ratio $(L_3/(L_1+L_2))$ between the length $(L_3)$ of the velocity taper section 7 of the output side delay line circuit and the total length $(L_1+L_2)$ of the output side delay line circuit 9 and the minimum value of $I_{st}/I_{sto}$.

In the output side delay line circuit 9, as the ratio $(2(P_1-P_2)/(P_1+P_2)$ is increased, the coupling degree to the fundamental waves is degraded so that the circuit length $(L_1+L_2)$ of the output side delay line circuit has to be increased to make a desired gain. For the backward traveling waves oscillation, on the other hand, no remarkable effects can be attained even if the value of $2(P_1-P_2)/(P_1+P_2)$ is increased to a considerable level. This fact is apparent from FIG. 2, in which the ratio $(I_{st}/I_{sto})$ is plotted as a function of the ratio $2(P_1-P_2)/(P_1+P_2)$. This ratio is between the current $I_{sto}$ for starting the backward traveling wave oscillation, in case no velocity taper is established, and the current $I_{st}$ for starting the backward traveling wave oscillation, in case the velocity taper is established. The present invention further improves the relationship between the minimum value after the ratio $(I_{st}/I_{sto})$ in FIG. 2 rises and the ratio $(L_3/(L_1+L_2))$ between the total length $(L_1+L_2)$ of the output side delay line circuit 9. The length $(L_3)$ of the velocity taper section 7 improves so that a better velocity taper may be provided in accordance with the ratio $(I_{col}/I_{sto})$ between the current $I_{sto}$ and a collector current $I_{col}$.

For the relationships of the ratio $(I_{st}/I_{sto})$ to the ratio $(2(P_1-P_2)/(P_1+P_2))$, the inventor has made many calculations using a parameter comprising the ratio $(L_3/(L_1+L_2))$ of the length $(L_3)$ of the velocity taper section to the total length $(L_1+L_2)$ of the output side delay the circuit 9. He has found that, for the small value of $L_3/(L_1+L_2)$, as shown in FIG. 2, the value of $2(P_1-P_2)/(P_1+P_2)$ becomes smaller as the value $(I_{st}/I_{sto})$ rises. The minimum value, after the rise, also becomes smaller. It has also been found that, for the large value of $L_3/(L_1+L_2)$, the value of $2(P_1-P_2)/(P_1+P_2)$ becomes larger as the value $(I_{st}/I_{sto})$ rises. The minimum value, after the rise, also becomes larger. Therefore, if the ratio $(I_{col}/I_{sto})$ of the collector current $I_{col}$ to the current $I_{sto}$ is small, the value $(L_3/(L_1+L_2))$ is reduced so that a preset gain can be made without appreciably elongating the output side delay line circuit, by establishing the velocity taper. On the contrary, if the ratio $(I_{col}/I_{sto})$ is large, the value $(L_3/(L_1+L_2))$ is increased to suppress the backward traveling wave oscillation. At this time, the length of the output side delay line circuit is increased to some extent in comparison with the case where the value $(L_3/(L_1+L_2))$ is small.

Figure 5:
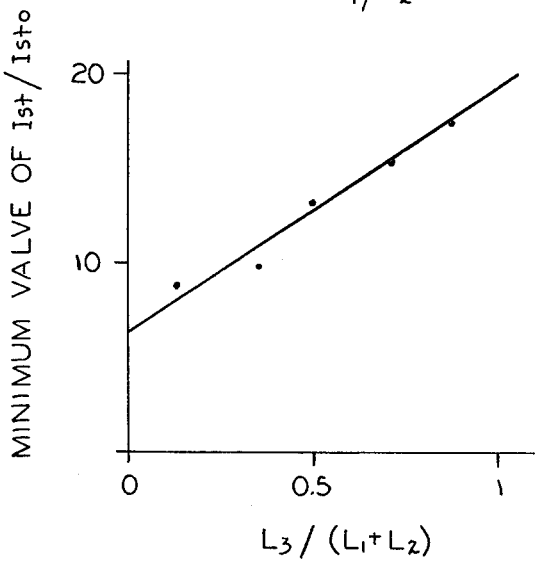
FIG. 5 is a graphical presentation illustrating the variation of the minimum value of the ratio $I_{st}/I_{sto}$ to the ratio $L_3/(L_1+L_2)$ after the ratio $I_{st}/I_{sto}$ rises.

FIG. 5 shows the relationship of the minimum value after the ratio $(I_{st}/I_{sto})$ in FIG. 2 rises to the value $(L_3/L_1+L_3))$. A straight line approximately linking points of the actual values appearing in FIG. 5 can be given by the following equation:

$$I_{sl}/I_{sto}=13.3(L_3/(L_1+L_2))+6.7 \quad (3)$$

Therefore, the length $L_3$ of the velocity taper for suppressing the backward traveling wave oscillation in the helix type traveling wave tube is preferably selected to satisfy the following inequality:

$$I_{col}/I_{sto}<13.3(L_3/(L_1+L_2))+6.7 \quad (4)$$

If the value of $L_3/(L_1+L_2)$ satisfies the inequality (4), it is possible to obtain the velocity taper for the best suppression of the backward traveling waves in accordance with the value ($I_{col}/I_{sto}$).

Figure 6:
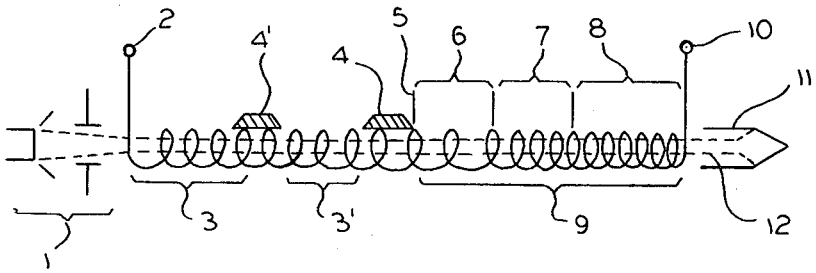
FIG. 6 is diagrammatical view showing another embodiment of a helix type traveling wave tube of this invention which is equipped with two electromagnetic wave attenuators.

Moreover, the velocity taper according to the present invention can be applied not only to the output side delay line circuit (if the delay line circuit is divided by the single electromagnetic wave attenuator) but also to either a delay line circuit 9 between the electromagnetic wave output section 10 and an electromagnetic wave attenuator 5 or a delay line circuit 3' between electromagnetic wave attenuators 4 and 4', if the delay line circuit is divided into three portions 3, 3' and 9 by a plurality of electromagnetic wave attenuators 4 and 4', as shown in FIG. 6.

FIG. 6 illustrates the velocity taper applied to the output side delay circuit 9 of the three-divided delay line circuit tube. Reference numeral 3' indicates an intermediate delay line circuit which has the same helix pitch as that of the input side delay line circuit 3. Numeral 4' indicates an electromagnetic wave attenuator. The other element appearing in FIG. 6 are the same as those in FIG. 1.

Finally, the numerical examples of the present invention will be described hereinafter. In case a prior art traveling wave tube is constructed with the average pitch helix of $(P_1+P_2)/2$, the oscillatory frequency and the current for starting the oscillation of the backward traveling wave are 22 GHz and 48 mA, respectively. The operating current ($I_{col}$) is 250 mA. At this time, the backward traveling wave oscillation can be suppressed by adding the velocity taper of $L_1/L_2=1.16$, $2(P_1-P_2)/(P_1+P_2)=0.06$ and $L_3(L_1+L_2)=0.36$ according to the present invention.

What is claimed is:

1. A helix-type traveling wave tube comprising a helix-type delay line means extending from an input side to an output side, electron gun means adjacent said input side of said helix means, collector means adjacent the output side of said helix means, attenuator means for dividing said helix delay means intermediate said input side and said output side; the pitch of said helix between said attenuator and said input side being a pitch ($P_0$), the pitch ($P_1$) of a first part of said helix between said attenuator and said output side being greater than the pitch ($P_0$) and forming a fast velocity circuit, the pitch ($P_2$) of a second part of said helix between said attenuator and said output side being less than the pitch ($P_0$) and forming a slow velocity circuit, and a third part of said helix interposed between said first and second parts for forming a velocity taper section having a helix pitch which varies from the larger pitch ($P_1$) to the smaller pitch ($P_2$), one position in the third part of said helix having an average pitch of $(P_1+P_2)2$, a first length of ($L_1$) of said helix including all of said first part and continuing to said one position, a second length ($L_2$) of said helix includes all of said second part and continuing to said one position, the ratio $L_1/L_2$ ranging from 0.6 to 2, and the ratio $(2(P_1-P_2)/(P_1+P_2))$ of the difference between pitches $P_1$ and $P_2$ to the average pitch ranging from 0.04 to 0.14.

2. A helix-type traveling wave tube as claimed in claim 1, in which the ratio between a length ($L_3$) of the third part velocity taper section of said helix delay line circuit and the total length $(L_1+L_2)$ satisfies the following inequality $$I_{col}/I_{sto}13.3\times[L_3/(L_1+L_2)]+6.7$$

where: $I_{sto}$ represents a backward traveling wave oscillation starting current when the circuit is constructed with the average helix pitch $((P_1+P_2)/2)$ without the velocity taper section and $I_{col}$ represents an operation current.

3. A helix type traveling wave tube as claimed in claim 1 or 2, in which said delay line circuit is divided in a high frequency manner by means of a plurality of electromagnetic wave attenuators.

4. A device for suppressing backward traveling waves in a helix type of traveling wave tube, said backward traveling wave having a minus-1 space harmonic, said device comprising means for projecting an electron beam through said helix, means for providing a velocity taper section in said helix, means including said velocity taper section for coupling the minus-1 space harmonic with said electron beam, the interaction range of said coupled space harmonic and electron beam being narrow as compared with the frequency of a fundamental wave in said traveling wave tube, attenuator means for dividing said helix into two portions, wherein a first portion of said divided helix is subdivided into three parts, a first of said parts having a long pitch and forming a fast velocity section of a delay line, a second of said parts having a short pitch and forming a slow velocity section of said delay line, a third of said parts forming a velocity taper section between said first and said second parts, the pitch of said helix varying from said long pitch to said short pitch in said velocity taper section, the third of said parts having a pitch which varies from said long to said short pitches and a point where its pitch is the average between said long and said short pitches, and the ratio $(L_1/L_2)$ being in the range of 0.6 to 2; where: $L_1$ is the length of said helix on the side of said point including said first part, and $L_2$ is the length of said helix on the other side of said point including said second part of said helix.

5. The device of claim 4 wherein the ratio of the differences between said average pitch and said long and short pitch ranges from 0.04 to 0.14.

6. The device of claim 5 wherein the ratio of the length $(L_1+L_2)$ of said first portion to the length of said third part ($L_3$) is:

$$I_{COL}/I_{STO}13.3\times[L_3/(L_1+L_2)]+6.7$$

where:

$I_{STO}$ is the current required to start backward traveling wave oscillation, $I_{COL}$ is the operating current of the traveling wave tube.

7. The device of any one of the claims 4, 5 or 6 and second attenuator means for dividing a second portion of said helix into two sub-portions.

* * * * *

UNITED STATES PATENT AND TRADEMARK OFFICE

CERTIFICATE OF CORRECTION

PATENT NO. : 4,378,512

DATED : March 29, 1983

INVENTOR(S) : KUNIO TSUTAKI

It is certified that error appears in the above—identified patent and that said Letters Patent is hereby corrected as shown below:

Col. 1, Line 17, insert --these-- after "Among";

Col. 5, Line 24, change "illustrate" to --illustrates--;

Col. 5, Line 55, delete the comma "," after "shown".

Signed and Sealed this

*Eleventh* Day of *October 1983*

[SEAL]

*Attest:*

GERALD J. MOSSINGHOFF

*Attesting Officer*

*Commissioner of Patents and Trademarks*